US005919592A

United States Patent [19]

Yaguchi et al.

[11] Patent Number: 5,919,592

[45] Date of Patent: Jul. 6, 1999

[54] YELLOW TONER FOR COLOR ELECTROPHOTOGRAPHY

[75] Inventors: Hiroshi Yaguchi; Nobutaka Kinoshita; Satoru Miyamoto, all of Shizuoka, Japan

[73] Assignee: Ricoh Company, Ltd., Tokyo, Japan

[21] Appl. No.: 09/080,716

[22] Filed: May 19, 1998

[30] Foreign Application Priority Data

May 19, 1997 [JP] Japan ..... 9-144711
May 18, 1998 [JP] Japan ..... 10-153628

[51] Int. Cl.[6] ..... G03G 9/09
[52] U.S. Cl. ..... 430/106
[58] Field of Search ..... 430/106

[56] References Cited

U.S. PATENT DOCUMENTS 4,575,478 3/1986 Ohno ..... 430/137
5,554,478 9/1996 Kuramoto et al. ..... 430/109
5,578,407 11/1996 Kasuya et al. ..... 430/106

*Primary Examiner*—Roland Martin
*Attorney, Agent, or Firm*—Oblon, Spivak, McClelland, Maier & Neustadt, P.C.

[57] ABSTRACT

A yellow toner for full-color electrophotography is made of yellow toner particles, each toner particle containing a binder resin and C.I. Pigment Yellow 62 and/or C.I. Pigment Yellow 168 as a yellow coloring agent. The above-mentioned yellow toner is used in combination with a carrier to prepare a two-component yellow developer.

12 Claims, No Drawings

YELLOW TONER FOR COLOR ELECTROPHOTOGRAPHY

BACKGROUND OF THE INVENTION

1. Field of the Invention

The present invention relates to a toner for use in the electrophotographic copying machine, laser printer, and facsimile apparatus, and more particularly to a yellow toner for use in the electrophotographic color image formation process.

2. Discussion of Background

In the electrophotographic copying machine characterized by comprising the step of developing latent electrostatic images into visible toner images with a developer, the aforementioned latent electrostatic images are first formed on the surface of a photoconductor comprising a dielectric material, the latent electrostatic images are developed to toner images with a developer, and then the toner images are transferred to an image-receiving member such as a sheet of paper and thereafter fixed thereto by the application thereto of heat and/or pressure. Thus, visible toner images can be formed on the image-receiving member.

In recent years, with the increase of demand for the formation of full-color copy image, the consumption of a full-color toner is increasing. To obtain a full-color image, a document is subjected to color separation using a scanner, and the color image data read by the scanner is recorded using a laser beam, and then light exposure is carried out. Each color image is developed with a yellow toner, a magenta toner, or a cyan toner, and further, optionally with a black toner. The thus obtained color images are superimposed to produce a full-color image.

The requirements for the color toner, which are not similar to those for the black toner comprising carbon black as a coloring agent, include color tone, tinting strength, light resistance, heat resistance, and transparency of a pigment or dye to be employed as the coloring agent in the color toner. In particular, the transparency of color toner is of great significance in order to obtain high quality clear color image because a color image is formed by superimposing a plurality of color toners, as previously mentioned.

In light of all the factors of light resistance, heat resistance and transparency, conventional yellow toners are considered to be still unsatisfactory. Therefore, color reproduction performance of conventional full-color images produced by the color copying machine is still poor, and in addition, when a full-color image is transferred to a transparent sheet such as an OHP film and fixed thereon, the projected image tends to be dull and poor in terms of saturation.

The benzidine pigment as disclosed in Japanese Laid-Open Patent Application 51-144627 is satisfactory with respect to the tinting strength, color tone, and transparency thereof. However, there is the problem from the viewpoint of environmental safety that such benzidine pigment is in danger of generating a carcinogenic material when heated.

For obtaining satisfactory color tone, tinting strength, light resistance, heat resistance and transparency of the yellow toner, it is proposed to employ a specific coloring agent, or the combination of coloring agents. For instance, a yellow toner comprising an allylamide based pigment is proposed in Japanese Laid-Open Patent Application 61-151550, which yellow toner is capable of stably producing high quality images free from fogging with excellent fixing properties during the continuous copying operation. Further, in Japanese Laid-Open Patent Application 3-55563, there is proposed a yellow toner comprising a quinophthalone pigment, which is excellent in spectral reflecting characteristics and charging characteristics, and therefore capable of always stably producing images.

However, none of the above-mentioned conventional yellow toners can completely meet all the requirements as shown below:

(1) assuming a clear yellow color with such sufficient spectral reflecting characteristics as to obtain excellent color reproduction performance.

(2) showing sufficient tinting strength and transparency owing to high dispersibility of a coloring agent in a binder resin.

(3) showing good light resistance.

(4) showing such a sufficient heat resistance as to cope with the fixing step under the application of heat, thereby preventing the surface of an image-fixing roller from being dyed with the toner.

(5) showing stable triboelectric charging characteristics regardless of change in ambient conditions.

(6) capable of preventing a carrier from being stained with the toner so as not to cause a so-called spent phenomenon when the toner is used as a two-component developer.

Furthermore, there remain many problems with respect to the transparency required for a yellow toner for use in color electrophotography.

SUMMARY OF THE INVENTION

Accordingly, a first object of the present invention is to provide a yellow toner with high transparency which is used for electrophotographic color image formation.

A second object of the present invention is to provide a yellow toner with high durability which is used for electrophotographic color image formation.

The above-mentioned objects of the present invention can be achieved by a yellow toner for full-color electrophotography comprising yellow toner particles, each toner particle comprising a binder resin and a coloring agent which comprises at least one yellow pigment selected from the group consisting of C.I. Pigment Yellow 62 and C.I. Pigment Yellow 168.

A third object of the present invention is to provide a two-component yellow developer for use in color electrophotography.

The above-mentioned third object of the present invention can be achieved by a two-component yellow developer for full-color electrophotography comprising a carrier and a yellow toner comprising yellow toner particles, each toner particle comprising a binder resin and a coloring agent which comprises at least one yellow pigment selected from the group consisting of C.I. Pigment Yellow 62 and C.I. Pigment Yellow 168.

DESCRIPTION OF THE PREFERRED EMBODIMENTS

A yellow toner according to the present invention comprises yellow toner particles, each toner particle comprising a binder resin and a coloring agent which comprises at least one yellow pigment selected from the group consisting of C.I. Pigment Yellow 62 and C.I. Pigment Yellow 168. By employing such a yellow pigment, the transparency of the obtained yellow toner is excellent. Further, the above-mentioned yellow pigments such as C.I. Pigment Yellow 62 and C.I. Pigment Yellow 168 exhibit good dispersibilities in a resin when kneaded to prepare a toner by the conventional process, and assume excellent yellow color tone because of good spectral reflecting characteristics.

In addition, when a two-component yellow developer is prepared using the above-mentioned yellow toner of the present invention, it is confirmed that the carrier can be prevented from being stained with toner. Namely, the spent toner phenomenon, that is caused by insufficient durability of toner itself, can be minimized when the yellow pigments for use in the present invention, such as C.I. Pigment Yellow 62 and C.I. Pigment Yellow 168 are employed as the coloring agents in the toner.

In other words, to cope with the enhancement of image quality produced by the electrophotographic copying machine, the size of toner particles is made smaller and smaller to improve the reproduction performance of a fine image portion. In this case, it is difficult to prepare uniform toner particles because the dispersion properties of the conventional yellow pigments are poor in the preparation of the toner. As a result, there are caused various problems with respect to the matching properties of the yellow toner with the copying machine, for example, defective development. In contrast to this, when the yellow pigments such as C.I. Pigment Yellow 62 and C.I. Pigment Yellow 168 are employed as the coloring agents in the toner, the above-mentioned conventional problems can be effectively solved.

The volume mean diameter of the toner particles for use in the yellow toner of the present invention can be controlled within a range of 3 to 20 $\mu$m. It is particularly preferable that the volume mean diameter of the toner particles be 8 $\mu$m or less in order to upgrade the reproduction performance of a fine image portion when high image quality is required by the copying machine.

Furthermore, the yellow pigments for use in the present invention, such as C.I. Pigment Yellow 62 and C.I. Pigment Yellow 168 are applicable to the preparation of a green toner.

When the binder resin for use in the yellow toner of the present invention comprises a polyol resin which comprises at least a bisphenol A type epoxy resin component, a bisphenol component, and an alkyleneoxide-modified epoxy resin component, the transparency of the obtained yellow toner can be further improved.

Further, to obtain the most preferable result, the above-mentioned polyol resin may further comprise a compound having in a molecule thereof an active hydrogen atom reactive with epoxy group.

In the yellow toner of the present invention, it is preferable that the amount of the coloring agent be in the range of 3 to 20 wt. % of the total weight of the binder resin. In such a case, both the transparency and the durability of the obtained yellow toner can be improved. When the amount of coloring agent is within the above-mentioned range, sufficient tinting strength can be obtained, and the transparency and charging characteristics of the obtained toner do not deteriorate with time.

It is confirmed by the inventors of the present invention that when the amount of conventional yellow pigment exceeds 6 wt. % of the binder resin, the characteristics of the obtained yellow toner, in particular, the transparency of toner tends to decrease. In contrast to this, the above-mentioned problem can be avoided when the coloring agent comprising C.I. Pigment Yellow 62 and/or C.I. Pigment Yellow 168 is contained in such an amount as mentioned above.

Furthermore, when C.I. Pigment Yellow 62 and/or C.I. Pigment Yellow 168 is used in combination with a binder resin with high transparency, a yellow toner with remarkably high transparency can be prepared.

According to the present invention, it is preferable that the haze of the yellow toner, which serves as an indication of the transparency of toner, be less than 30%. In this case, there can be obtained a full-color image with excellent color reproduction performance, and in addition, when a color image is formed on a transparent sheet such as an OHP film, a projected image can be provided with high saturation. Further, the haze of the yellow toner of the present invention may be decreased to 20% or less according to the application of toner, for example, the formation of minute images.

As compared with the case of conventional yellow toner comprising the conventional yellow pigment, the haze of the yellow color toner according to te present invention can be more easily controlled to less than 30% by appropriately choosing the kinds of other materials than the binder resin and the coloring agent, for instance, a charge control agent, a lubricant and other additives. Further, the haze of the yellow toner of the present invention can be decreased to 20% or less by severely selecting the kind of binder resin and the kinds of other materials and additives.

In the yellow color toner of the present invention, the conventional yellow pigments and dyes may be used in combination with the C.I. Pigment Yellow 62 and/or C.I. Pigment Yellow 168 when necessary.

Specific examples of such conventional yellow pigments and dyes are monoazo and disazo pigments and dyes, anthraquinone pigments, isoindolinone pigments, quinophthalone pigments, benzimidazolone pigments, and flavanthrone pigments.

In order not to impair the characteristics of the yellow color toner of the present invention, the above-mentioned conventional yellow pigments and dyes may be contained in the toner composition in an amount of 50 wt. % or less, preferably 30 wt. % or less, of the total amount of C.I. Pigment Yellow 62 and/or C.I. Pigment Yellow 168.

As previously mentioned, it is preferable that the binder resin for use in the present invention comprise a polyol resin comprising at least a bisphenol A type epoxy resin component, a bisphenol component, and an alkyleneoxide-modified epoxy resin component. In addition, the above-mentioned polyol resin may further comprise a compound having in a molecule thereof an active hydrogen atom reactive with epoxy group.

Such a binder resin may be used in combination with other conventional resins. One or more of those conventional resins may be used in combination. Further, those conventional resins may be modified or a polymer alloy may be prepared.

Specific examples of those conventionally known resins include styrene resins and styrene copolymer resins such as polystyrene, polychlorostyrene, polyvinyltoluene, styrene-vinyltoluene copolymer, styrene-vinylnaphthalene copolymer, styrene-acrylic acid copolymer, styrene-methacrylic acid copolymer, styrene-acrylonitrile copolymer, styrene-butadiene copolymer, and styrene-maleic acid ester copolymer; acrylic resin; vinyl resin; ethylenic resin; polyamide resin; polyester resin; phenolic resin; silicone resin; xylene resin; epoxy resin; terpene resin; and rosin and modified rosin.

The yellow color toner of the present invention may further comprise a charge control agent, a lubricant, a magnetic material and other additives.

As the charge control agent, there can be employed a metal chelate compound of alkylsalicylic acid or hydroxynaphthoic acid; fluorine-containing compounds as stated in Japanese Laid-Open Patent Applications 55-76353 and 3-213877; quaternary ammonium salts; oxides of metal alkyl as stated in Japanese Laid-Open Patent Application 56-164350; and resinous polymers comprising the above-mentioned compounds as functional groups. Of these charge control agents, the salicylic acid derivatives are preferable. Those conventional charge control agents may be used alone or in combination.

It is preferable that the amount of charge control agent be in the range of 0.5 to 10 wt. % of the total weight of the binder resin.

Specific examples of the lubricant for use in the present invention include higher fatty acids such as lauric acid and stearic acid; polyolefins and olefin copolymers such as polyethylene, polypropylene, ethylene-acrylic acid copolymer, ethylene-vinyl chloride copolymer, and ethylene oxide; and waxes such as carnauba wax, microcrystalline wax, paraffin wax and rice wax. Those conventional lubricants may be used alone or in combination.

It is preferable that the amount of lubricant be in the range of 0.5 to 10 wt. % of the total weight of the binder resin.

Examples of the magnetic material for use in the yellow toner include ferromagnetic substance such as iron, cobalt, or nickel; and alloys and compounds such as magnetite and ferrite. In light of the transparency of a yellow color toner, addition of those magnetic materials may be restrained.

The yellow color toner of the present invention may further comprise a variety of additives, for example, fluoroplastics such as finely-divided particles of vinylidene fluoride; metallic salts of fatty acids such as zinc stearate; metallic oxides such as zinc oxide, alumina and titanium oxide; and silica.

In order to impart high fluidity to the yellow toner particles, hydrophobic silica or finely-divided particles of titanium oxide with rutile structure may be added to the toner particles. In this case, it is preferable that the average particle size of primary particles of the above-mentioned fluidity-imparting agent be in the range of 0.001 to 1 $\mu$m, more preferably in the range of 0.005 to 0.1 $\mu$m. In particular, silica or titania which is surface-treated with an organic silane is preferably employed. The amount of such a fluidity-imparting agent may be in the range of 0.1 to 5 wt. %, more preferably in the range of 0.2 to 2 wt. % of the total weight of the toner particles.

In order to obtain color images with high transparency, the above-mentioned yellow color toner of the present invention may be used in combination with a carrier to prepare a two-component yellow developer.

As the material for the carrier, finely-divided particles with a particle size of about 30 to 1,000 $\mu$m comprising glass, iron, ferrite, nickel, zircon or silica are usable. Further, the above-mentioned finely-divided particles may be coated with styrene-acrylic resin, silicone resin, polyamide resin or polyvinylidene fluoride resin.

It is proper that the amount ratio by weight of the toner to the carrier be in the range of (0.5:100) to (6.0:100).

Other features of this invention will become apparent in the course of the following description of exemplary embodiments, which are given for illustration of the invention and are not intended to be limiting thereof.

EXAMPLE 1

A mixture of the following components was fused and kneaded in a double-screw kneader, and thereafter cooled to be hardened. The thus hardened solid material was roughly ground in a hammer mill and the particles thus obtained were passed through a screen of 2-mm mesh, so that yellow particles (Y11) were obtained:

| | Parts by Weight |
|---|---|
| Polyester resin (Glass transition point: about 58° C. Softening point: 109° C.) | 95 |
| Negative charge control agent (Azo dye of a chromium complex salt type) | 2 |
| Yellow pigment (C.I. Pigment Yellow 62) "IRGALITE Yellow WSR" (Trademark), made by Ciba Specialty Chemicals Inc. | 3 |

The yellow particles (Y11) were finely pulverized using a commercially available jet-type pulverizer "Model IDS-2" (Trademark), made by Nippon Pneumatic Mfg. Co., Ltd. until the volume mean diameter reached about 7.0 $\mu$m. Thus, finely-divided particles (Y21) were prepared.

Then, by use of a classifier, the finely-divided particles (Y21) were classified so as to obtain fine particles with a volume mean diameter of about 7.5 $\mu$m, including minute particles with a particle size of 5 $\mu$m or less in an amount of about 19% in terms of the number of particles. Thus, yellow toner particles (Y31) were obtained.

Thereafter, 10 g of silica surface-treated with hexamethyl disilazane and 2 kg of the above prepared yellow toner particles (Y31) were mixed in a 20-l Henschel mixer, whereby a yellow color toner (Y41) according to the present invention was obtained.

EXAMPLE 2

The procedure for preparation of the yellow particles (Y11) in Example 1 was repeated except that the polyester resin for use in the toner composition in Example 1 was replaced by a polyol resin with a glass transition point of about 60° C. and a softening point of about 110° C. which was a condensation product of (i) diglycidyl ether of bisphenol A, (ii) diglycidyl compound of bisphenol A propylene oxide adduct, (iii) bisphenol F, and (iv) p-cumylphenol. Thus, yellow particles (Y12) were obtained.

The yellow particles (Y12) were finely pulverized and classified so as to obtain fine particles with a volume mean diameter of about 7.7 $\mu$m, including minute particles with a particle size of 5 $\mu$m or less in an amount of about 18% in terms of the number of particles. Thus, yellow toner particles (Y32) were obtained.

Thereafter, 10 g of silica surface-treated with hexamethyl disilazane and 2 kg of the above prepared yellow toner particles were mixed in a 20-l Henschel mixer, whereby a yellow color toner (Y42) according to the present invention was obtained.

EXAMPLE 3

The procedure for preparation of the yellow particles (Y11) in Example 1 was repeated except that the commercially available yellow pigment (C.I. Pigment Yellow 62) "IRGALITE Yellow WSR" (Trademark), made by Ciba Specialty Chemicals Inc. for use in the toner composition in Example 1 was replaced by a commercially available yellow pigment (C.I. Pigment Yellow 168) "IRGALITE Yellow WGP" (Trademark), made by Ciba Specialty Chemicals Inc. Thus, yellow particles (Y13) were obtained.

The yellow particles (Y13) were finely pulverized and classified so as to obtain fine particles with a volume mean diameter of about 7.6 μm, including minute particles with a particle size of 5 μm or less in an amount of about 18% in terms of the number of particles. Thus, yellow toner particles (Y33) were obtained.

Thereafter, 10 g of silica surface-treated with hexamethyl disilazane and 2 kg of the above prepared yellow toner particles were mixed in a 20-l Henschel mixer, whereby a yellow color toner (Y43) according to the present invention was obtained.

EXAMPLE 4

The procedure for preparation of the yellow particles (Y12) in Example 2 was repeated except that the commercially available yellow pigment (C.I. Pigment Yellow 62) "IRGALITE Yellow WSR" (Trademark), made by Ciba Specialty Chemicals Inc. for use in the toner composition in Example 2 was replaced by a commercially available yellow pigment (C.I. Pigment Yellow 168) "IRGALITE Yellow WGP" (Trademark), made by Ciba Specialty Chemicals Inc. Thus, yellow particles (Y14) were obtained.

The yellow particles (Y14) were finely pulverized and classified so as to obtain fine particles with a volume mean diameter of about 7.7 μm, including minute particles with a particle size of 5 μm or less in an amount of about 16% in terms of the number of particles. Thus, yellow toner particles (Y34) were obtained.

Thereafter, 10 g of silica surface-treated with hexamethyl disilazane and 2 kg of the above prepared yellow toner particles were mixed in a 20-l Henschel mixer, whereby a yellow color toner (Y44) according to the present invention was obtained.

EXAMPLE 5

The procedure for preparation of the yellow particles (Y12) in Example 2 was repeated except that the amounts of the polyol resin, the charge control agent, and the yellow pigment were changed as follows:

| | Parts by Weight |
|---|---|
| Polyol resin (same as in Example 2) | 90 |
| Negative charge control agent (azo dye of a chromium complex salt type) | 2 |
| Yellow pigment (C.I. Pigment Yellow 62) "IRGALITE Yellow WSR" (Trademark), made by Ciba Specialty Chemicals Inc. | 8 |

Thus, yellow particles (Y15) were obtained.

The yellow particles (Y15) were finely pulverized and classified so as to obtain fine particles with a volume mean diameter of about 7.6 μm, including minute particles with a particle size of 5 μm or less in an amount of about 19% in terms of the number of particles. Thus, yellow toner particles (Y35) were obtained.

Thereafter, 10 g of silica surface-treated with hexamethyl disilazane and 2 kg of the above prepared yellow toner particles were mixed in a 20-l Henschel mixer, whereby a yellow color toner (Y45) according to the present invention was obtained.

EXAMPLE 6

The procedure for preparation of the yellow particles (Y15) in Example 5 was repeated except that the charge control agent was replaced by zinc salt of salicylic acid derivative. Thus, yellow particles (Y16) were obtained.

The yellow particles (Y16) were finely pulverized and classified so as to obtain fine particles with a volume mean diameter of about 7.5 μm, including minute particles with a particle size of 5 μm or less in an amount of about 18% in terms of the number of particles. Thus, yellow toner particles (Y36) were obtained.

Thereafter, 10 g of silica surface-treated with hexamethyl disilazane and 2 kg of the above prepared yellow toner particles were mixed in a 20-l Henschel mixer, whereby a yellow color toner (Y46) according to the present invention was obtained.

COMPARATIVE EXAMPLE 1

The procedure for preparation of the yellow color toner (Y41) in Example 1 was repeated except that the yellow pigment (C.I. Pigment Yellow 62) for use in the toner composition in Example 1 was replaced by a commercially available benzidine yellow pigment (C.I. Pigment Yellow 17) "ECY-215" (Trademark), made by DainichiSeika Color and Chemicals Mfg. Co., Ltd.

Thus, a comparative yellow color toner was obtained.

COMPARATIVE EXAMPLE 2

The procedure for preparation of the yellow color toner (Y41) in Example 1 was repeated except that the yellow pigment (C.I. Pigment Yellow 62) for use in the toner composition in Example 1 was replaced by a commercially available allylamide yellow pigment (C.I. Pigment Yellow 93) "Cromophthal Yellow 3G" (Trademark), made by Ciba Specialty Chemicals Inc.

Thus, a comparative yellow color toner was obtained.

COMPARATIVE EXAMPLE 3

The procedure for preparation of the yellow color toner (Y41) in Example 1 was repeated except that the yellow pigment (C.I. Pigment Yellow 62) for use in the toner composition in Example 1 was replaced by a commercially available quinophthalone yellow pigment (C.I. Pigment Yellow 138) "Paliotol Yellow L0962HD" (Trademark), made by BASF Japan Ltd.

Thus, a comparative yellow color toner was obtained.

COMPARATIVE EXAMPLE 4

The procedure for preparation of the yellow color toner (Y41) in Example 1 was repeated except that the yellow pigment (C.I. Pigment Yellow 62) for use in the toner composition in Example 1 was replaced by a commercially available yellow dye (C.I. Solvent Yellow 162) "Neozapon Yellow-073" (Trademark), made by BASF Japan Ltd.

Thus, a comparative yellow color toner was obtained.

To prepare a two-component yellow developer, 5 parts by weight of each of the above prepared yellow color toners and 95 parts by weight of silicone-resin-coated carrier particles with a particle size of about 80 μm were mixed and stirred.

Each two-component yellow developer thus prepared was incorporated into a commercially available full-color copying machine "PRETER 550" (Trademark), made by Ricoh Company, Ltd., and 10,000 copies were continuously made.

After completion of continuous copying operation, to evaluate the durability of the yellow developer, the spent phenomenon of carrier particles was examined by the following method: 5 g of the two-componet yellow developer and 30 g of methyl ethyl ketone were placed into a glass container, and ultrasonic vibration was applied to the above prepared mixture for 30 seconds. Then, a supernatant liquid sample was collected and the turbidity of each sample was measured using a turbidimeter. In view of the results of the turbidity, the durability of each yellow toner was evaluated on a scale from 1 to 5 as shown below.

5: Excellent

4: Good

3: Slightly poor

2: Poor

1: Not acceptable in practical use

The results are shown in TABLE 1.

Further, to evaluate the transparency of the yellow toner, a yellow toner image was formed on a commercially available OHP film with a toner deposition amount of about 1 $mg/cm^2$ and the haze of the obtained yellow image was measured using a commercially available measuring instrument "HGM-2DP" (Trademark), made by Suga Test Instruments Co., Ltd.

The results are also shown in TABLE 1. The lower the value of the haze, the higher the transparency.

TABLE 1

| | Durability of Yellow Developer | Haze Value (%) |
|---|---|---|
| Ex. 1 | 5 | 32 |
| Ex. 2 | 5 | 23 |
| Ex. 3 | 5 | 34 |
| Ex. 4 | 5 | 23 |
| Ex. 5 | 5 | 23 |
| Ex. 6 | 5 | 16 |
| Comp. Ex. 1 | 3 | 43 |
| Comp. Ex. 2 | 4 | 45 |
| Comp. Ex. 3 | 4 | 48 |
| Comp. Ex. 4 | 2 | 30 |

As previously explained, the yellow color toner of the present invention comprises as a coloring agent C.I. Pigment Yellow 62 and/or C.I. Pigment Yellow 168, so that the yellow toner of the present invention can meet various characteristics required for a full-color toner. Further, when the yellow toner of the present invention comprises as a binder resin a specific polyol resin as mentioned above, the transparency can be particularly improved. Japanese Patent Application No. 09-144711 filed May 19, 1997 and Japanese Patent Application filed May 18, 1998 are hereby incorporated by reference.

What is claimed is:

1. A yellow toner for full-color electrophotography, comprising yellow toner particles, each toner particle comprising a binder resin and a coloring agent which comprises at least one yellow pigment selected from the group consisting of C.I. Pigment Yellow 62 and C.I. Pigment Yellow 168, wherein said binder resin comprises a polyol resin which comprises at least a bisphenol A epoxy resin component, a bisphenol component, and an alkyleneoxide-modified epoxy resin component.

2. The yellow toner as claimed in claim 1, wherein said polyol resin further comprises a compound having in a molecule thereof an active hydrogen atom reactive with epoxy group.

3. The yellow toner as claimed in claim 1, wherein said coloring agent is contained in an amount of 3 to 20 wt. % of said binder resin.

4. The yellow toner as claimed in claim 1, further comprising a salicylic acid derivative as a negative-charge controlling agent.

5. The yellow toner as claimed in claim 1, wherein said yellow toner particles have a volume mean diameter of 8 $\mu$m or less.

6. The yellow toner as claimed in claim 1, wherein the haze of said yellow toner is less than 30%.

7. A two component yellow developer for color electrophotography, comprising a carrier and a yellow toner comprising yellow toner particles, each toner particle comprising a binder resin and a coloring agent which comprises at least one yellow pigment selected from the group consisting of C.I. Pigment Yellow 62 and C.I. Pigment Yellow 168, wherein said binder resin comprises a polyol resin which comprises at least a bisphenol A epoxy resin component, a bisphenol component, and an alkyleneoxide-modified epoxy resin component.

8. The yellow developer as claimed in claim 7, wherein said polyol resin further comprises a compound having in a molecule thereof an active hydrogen atom reactive with epoxy group.

9. The yellow developer as claimed in claim 7, wherein said coloring agent is contained in an amount of 3 to 20 wt. % of said binder resin.

10. The yellow developer as claimed in claim 7, wherein said yellow toner further comprises a salicylic acid derivative as a negative-charge controlling agent.

11. The yellow developer as claimed in claim 7, wherein said yellow toner particles have a volume mean diameter of 8 $\mu$m or less.

12. The yellow developer as claimed in claim 7, wherein the haze of said yellow toner is less than 30%.

* * * * *

UNITED STATES PATENT AND TRADEMARK OFFICE

CERTIFICATE OF CORRECTION

PATENT NO. : 5,919,592

DATED : July 6, 1999

INVENTOR(S): Hiroshi YAGUCHI ET AL.

It is certified that an error appears in the above-identified patent and that said Letters Patent is hereby corrected as shown below:

Column 4, line 15, "te" should read --the--.

Column 9, line 4, "componet" should read --component--.

Column 9, line 52, "Patent Application filed" should read --Patent Application No. 10-153628 filed--.

Signed and Sealed this

Twelfth Day of September, 2000

*Attest:*

Q. TODD DICKINSON

*Attesting Officer*

*Director of Patents and Trademarks*